US008413380B1

(12) United States Patent
Bredl et al.

(10) Patent No.: US 8,413,380 B1
(45) Date of Patent: Apr. 9, 2013

(54) UNIVERSAL SWING HINGE AND GRAVITY-CLOSING GATE ASSEMBLY

(75) Inventors: Erich Edwin Bredl, Houston, TX (US); Lakshminarasimhan S. Muthu, Pearland, TX (US)

(73) Assignee: Intrepid Industries, Inc., La Porte, TX (US)

( * ) Notice: Subject to any disclaimer, the term of this patent is extended or adjusted under 35 U.S.C. 154(b) by 0 days.

(21) Appl. No.: 13/465,881

(22) Filed: May 7, 2012

(51) Int. Cl.
*E05D 7/06* (2006.01)

(52) U.S. Cl.
USPC ..... 49/236

(58) Field of Classification Search ..... 49/236, 49/240, 241, 242, 243, 244, 245; 16/309, 16/310, 311
See application file for complete search history.

(56) References Cited

U.S. PATENT DOCUMENTS 350,189 A * 10/1886 Denney ..... 49/240
2,569,836 A * 10/1951 Tilbury ..... 49/245
2,642,683 A * 6/1953 Meyer, Jr. ..... 49/70
3,264,786 A * 8/1966 Nettles ..... 49/70
3,594,853 A * 7/1971 Slattery ..... 16/354
3,848,293 A * 11/1974 Marchione et al. ..... 16/297
4,611,433 A * 9/1986 Heizer, Jr. ..... 49/242
5,592,717 A * 1/1997 Longo ..... 16/367

* cited by examiner

*Primary Examiner* — Jerry Redman
(74) *Attorney, Agent, or Firm* — Buskop Law Group, PC; Wendy Buskop

(57) ABSTRACT

A universal swing hinge assembly and gravity-closing gate assembly can be attached to a guardrail on either side of a guardrail opening. A hinge pin can be disposed through the universal swing hinge assembly and the gravity-closing gate for attaching the gravity-closing gate thereto. The universal swing hinge assembly can have a C-configuration that allows the gravity-closing gate to swing open in either direction from a lowest neutral position. A recess of the universal swing hinge assembly can have an angled hinge face that opens towards the guardrail opening. In operation, the angled hinge face can cause the gravity-closing gate to rise from the lowest neutral position when the gravity-closing gate is opening, and the angled hinge face can cause the gravity-closing gate to return to the lowest neutral position when closing.

23 Claims, 12 Drawing Sheets

UNIVERSAL SWING HINGE AND GRAVITY-CLOSING GATE ASSEMBLY

FIELD

The present embodiments generally relate to a universal swing hinge and gate assembly for selectively attaching a gravity-closing gate to either side of a guardrail opening.

BACKGROUND

A need exists for a universal swing hinge and gate assembly for attaching a gravity-closing gate to either side of a guardrail opening without requiring modification to the universal swing hinge and gate assembly or additional equipment.

A need exists for a universal swing hinge and gate assembly having a universal swing hinge assembly configured to allow the gravity-closing gate to open in a first direction and close in an opposite direction based on which side of the guardrail opening the universal swing hinge assembly is attached to.

A need exists for a universal swing hinge and gate assembly having a universal swing hinge assembly that can be attached to flat portions of guardrails, such as angle iron, and rounded portions of guardrails, such as round pipes.

A need exists for a universal swing hinge and gate assembly that includes a universal swing hinge assembly with a recess having an angled hinge face configured to allow the gravity-closing gate to rise in either direction from the lowest neutral position as the gravity-closing gate is opening, and to allow the gravity-closing gate to automatically return via gravity in either direction to the lowest neutral position and closed configuration.

The present embodiments meet these needs.

BRIEF DESCRIPTION OF THE DRAWINGS

The detailed description will be better understood in conjunction with the accompanying drawings as follows.

Figure 1A:
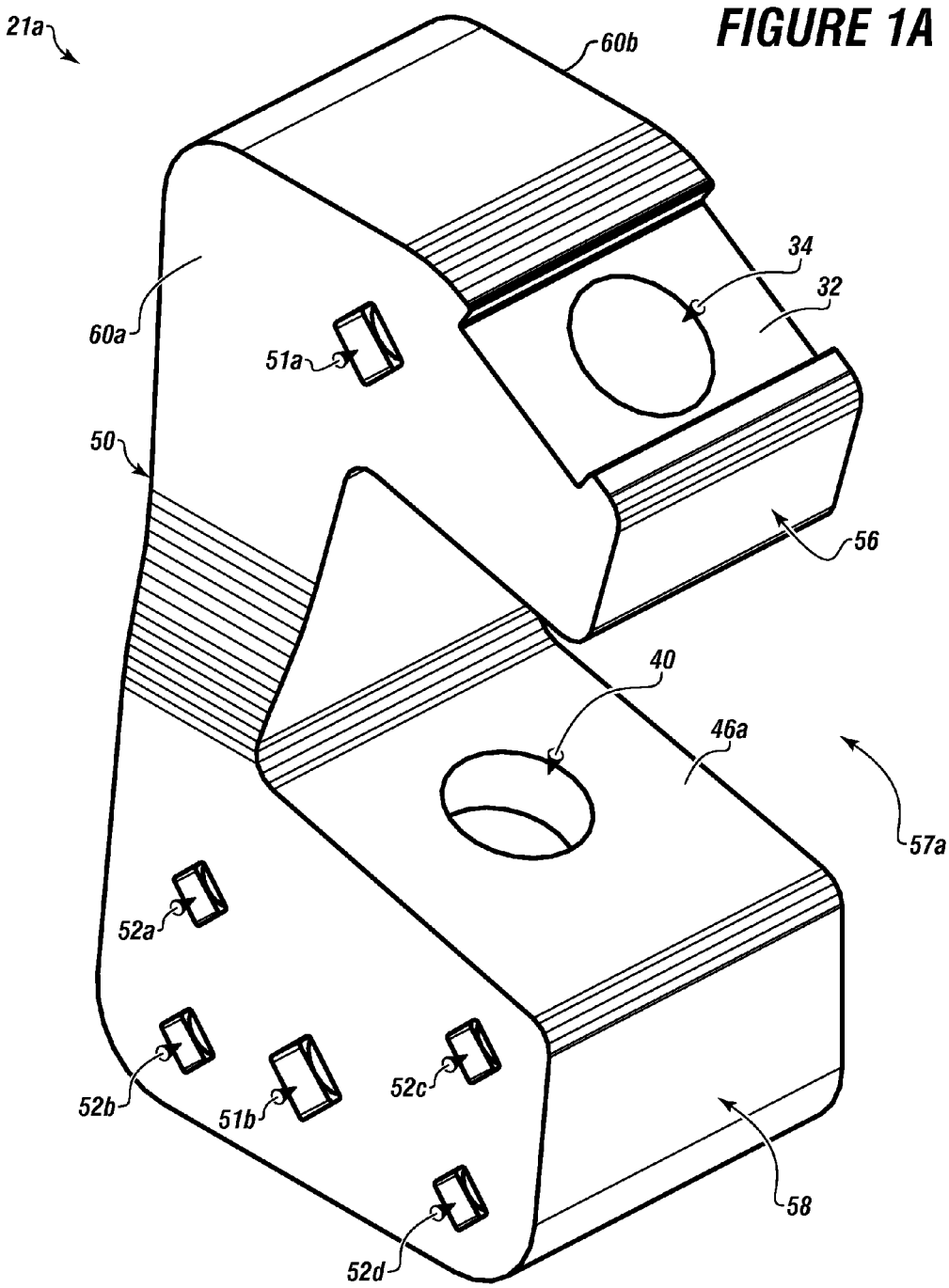
FIG. 1A depicts a perspective view of the universal swing hinge assembly according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a universal swing hinge and gate assembly for attaching a gravity-closing gate to either side of a guardrail opening.

The universal swing hinge and gate assembly can be configured to have superior weatherabilty properties to prevent deformation and fracturing, such as during harsh weather. For example, the universal swing hinge and gate assembly can be made of polyurethane, such as INSTANT SET POLYMER™.

In one or more embodiments, the universal swing hinge and gate assembly can be configured to maintain structural integrity during and after a 400 pound impact test without the gravity-closing gate breaking. As such, the universal swing hinge and gate assembly can support the weight of persons and prevent persons from falling through the guardrail opening. The universal swing hinge and gate assembly can be installed on offshore and onshore structures, such as at refineries, chemical plants, manufacturing facilities, factories, floating platforms, or the like. This design function allows the universal swing hinge assembly to prevent death and serious injury.

The universal swing hinge assembly can engage with the gravity-closing gate, such as via a hinge pin disposed through a hinge pin hole. The universal swing hinge assembly and the gravity-closing gate can be made of polyurethane, another polymer, metal, wood, other construction materials, or combinations thereof.

The universal swing hinge assembly can be configured to be attached to a guardrail on a first side or second side of a guardrail opening within the guardrail, such as via bolts, clamps, other fasteners, or combinations thereof. The guardrail can be made of steel, iron, wood, fiberglass reinforced polymers, or combinations thereof.

The guardrail can be a guardrail at a worksite, such as a refinery, chemical plant, manufacturing facility, factory, onshore facility, offshore facility, or another site. The gravity-closing gate can restrict passage through the guardrail opening.

The universal swing hinge assembly can have an upper hinge portion with a hinge pin thru hole disposed along a hinge axis at a first angle from a hinge assembly axis. For example, the hinge assembly axis can be disposed perpendicular to a surface that the guardrail is attached to, and the hinge axis can be at an angle to the hinge assembly axis that is greater than zero and less than ninety degrees, such that the hinge axis is oblique relative to the surface that the guardrail is attached to.

The universal swing hinge assembly can have a back portion connected between the upper hinge portion and a lower hinge portion. In one or more embodiments, the upper hinge portion, back portion, and lower hinge portion can be a one-piece construction.

The lower hinge portion can have a hole, which can be a thru hole or a blind hole, formed therein. The hole can be axially aligned with the hinge pin thru hole, such that the hole is disposed oblique relative to the surface that the guardrail is attached to.

A recess can be formed in the universal swing hinge assembly between the upper hinge portion and the lower hinge portion. The recess can have an angled hinge face disposed at a second angle from the hinge assembly axis, such that a plane of the angled hinge face extends oblique to the surface that the guardrail is attached to.

The hinge axis can extend perpendicular to the angled hinge face.

The angled hinge face can slope upwards from the guardrail opening in one or more directions.

When installed on the guardrail, the recess can open towards the guardrail opening, such that the upper hinge portion and lower hinge portion extend from the back portion towards the guardrail opening.

A portion of the gravity-closing gate having the hinge pin hole can be disposed within the recess.

A hinge pin can be disposed through the hinge pin thru hole, through the hinge pin hole, and at least partially into the hole in the lower hinge portion; thereby attaching the gravity-closing gate to the universal swing hinge assembly.

The hinge pin can extend along the hinge axis, such that the hinge pin extends oblique relative to the surface that the guardrail is attached to.

A height of the angled face can increase from the opening of the recess towards the back portion.

In operation, with the gravity-closing gate attached with the hinge pin, when the gravity-closing gate is opened the gravity-closing gate can rotate about the hinge axis. As the gravity-closing gate is opening, the angled hinge face can cause the gravity-closing gate to rise. As such, when the gravity-closing gate is in an opened configuration or at least partially opened configuration, gravity can act upon the gravity-closing gate to close the gravity-closing gate.

When the gravity-closing gate is closed, the gravity-closing gate can have a length sufficient to engage the guardrail on a side of the guardrail opening opposite the universal swing hinge assembly, such that the gravity-closing gate restricts access and restrains movement through the guardrail opening.

In one or more embodiments, the recess can allow the gravity-closing gate to swing on the hinge pin from the closed configuration with the gravity-closing gate engaged with the guardrail to an opened configuration.

In operation, when the universal swing hinge assembly is attached to the first side of the guardrail opening, the universal swing hinge assembly can allow the gravity-closing gate to only swing open towards the first side of the guardrail opening, and to only swing closed towards the second side of the guardrail opening. When the universal swing hinge assembly is attached to the second side of the guardrail opening, the universal swing hinge assembly can allow the gravity-closing gate to only swing open towards the second side of the guardrail opening, and to only swing closed towards the first side of the guardrail opening.

The gravity-closing gate can be a single bar gravity-closing gate, double bar gravity-closing gate, or another gravity-closing gate configuration.

In one or more embodiments, the gravity-closing gate can include one or more distance indicators for indicating a distance along the gravity-closing gate.

The universal swing hinge assembly can be configured to attach the gravity-closing gate to a flat portion of the guardrail, a rounded portion of the guardrail, or combinations thereof.

For example, the universal swing hinge assembly can have one or more holes disposed through the upper hinge portion, lower hinge portion, back portion, or combinations thereof. Fasteners can be disposed through the one or more holes and engaged into the flat portion of the guardrail; thereby holding the universal swing hinge assembly and the gravity-closing gate to the flat portion of the guardrail.

Also, the universal swing hinge assembly can have one or more bolt holes, such as pipe bolt holes disposed therethrough. One or more clamps can be disposed around the rounded portion of the guardrail. Pipe bolts or the like can be engaged through the bolt holes, through the clamps, through washers, and with nuts; thereby holding the universal swing hinge assembly and the gravity-closing gate to the rounded portion of the guardrail.

One or more embodiments can include a stopper extending from a portion of the gravity-closing gate. The stopper can extend towards the side of the guardrail opening that the universal swing hinge assembly is attached to. The stopper can prevent movement of the gravity-closing gate beyond a preset limit. For example, if a person falls on or against the gravity-closing gate, the stopper can engage the guardrail to provide a point of contact between the gravity-closing gate and the guardrail. The stopper can be made of the same materials as the gravity-closing gate.

One or more embodiments can include a support block connected to the guardrail on the side of the guardrail opening opposite the universal swing hinge assembly. The support block can be disposed below a portion of the gravity-closing gate and spaced apart therefrom.

In operation, the support block can engage the portion of the gravity-closing gate when the gravity-closing gate is moving downwards towards the surface that the guardrail is attached to; thereby preventing the gravity-closing gate from moving below the support block. As such, the support block can prevent damage to the universal swing hinge and gate assembly and injury to persons falling on or against the gravity-closing gate.

Figure 1B:
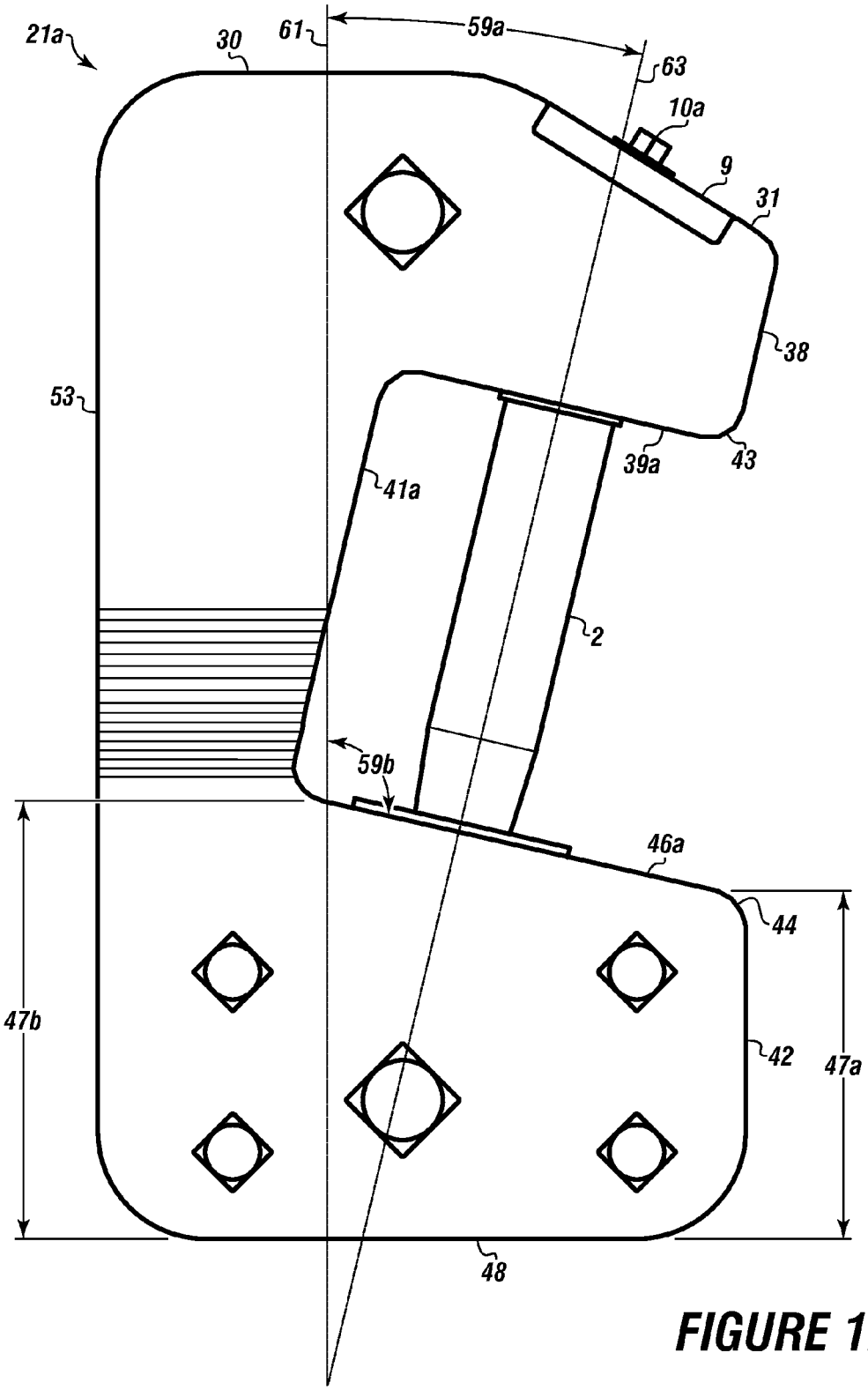
FIG. 1B depicts a side view of the universal swing hinge assembly with a hinge pin and cover plate according to one or more embodiments.
Figure 1C:
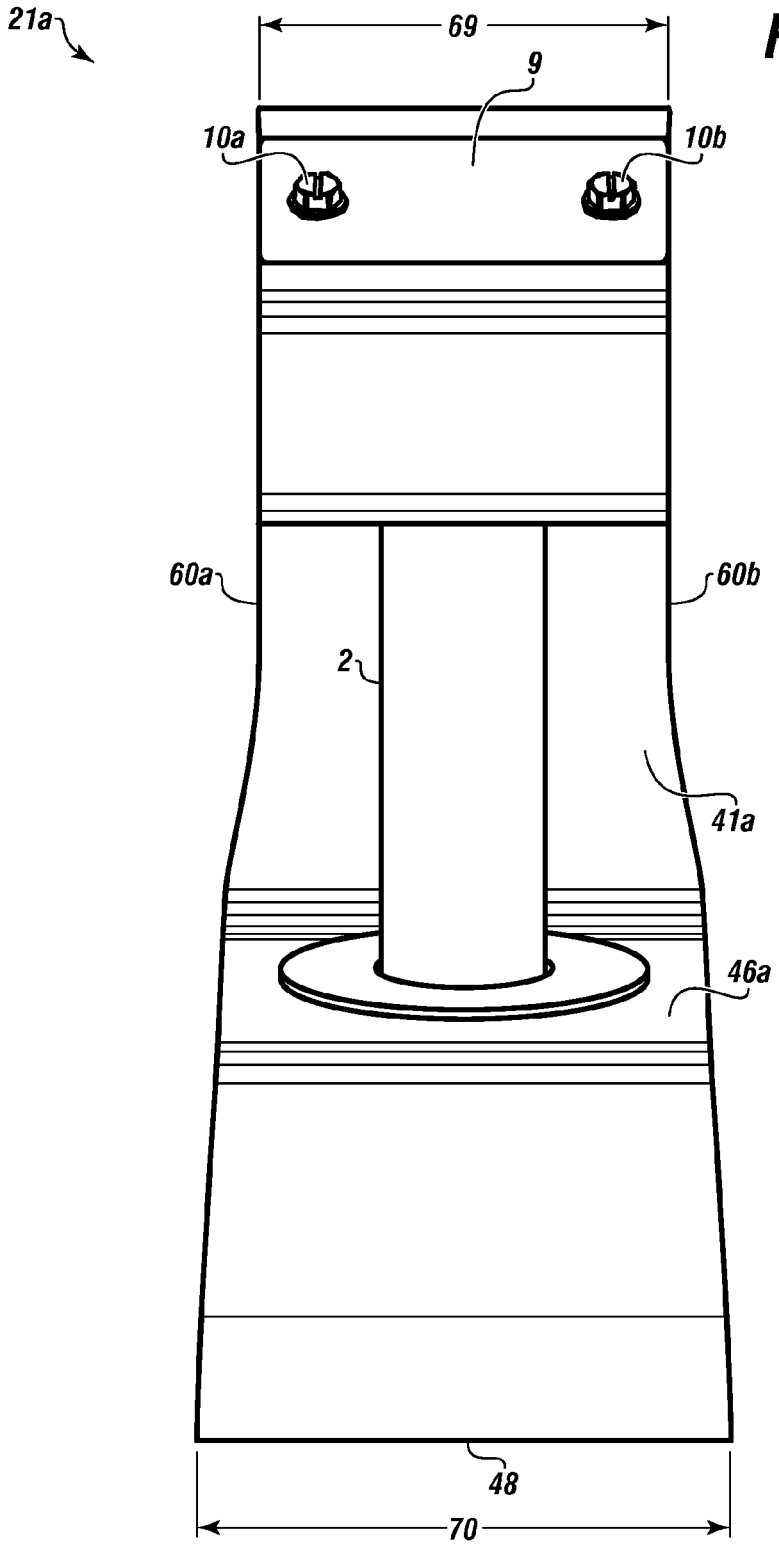
FIG. 1C depicts a front view of the universal swing hinge assembly according to one or more embodiments.
Figure 1D:
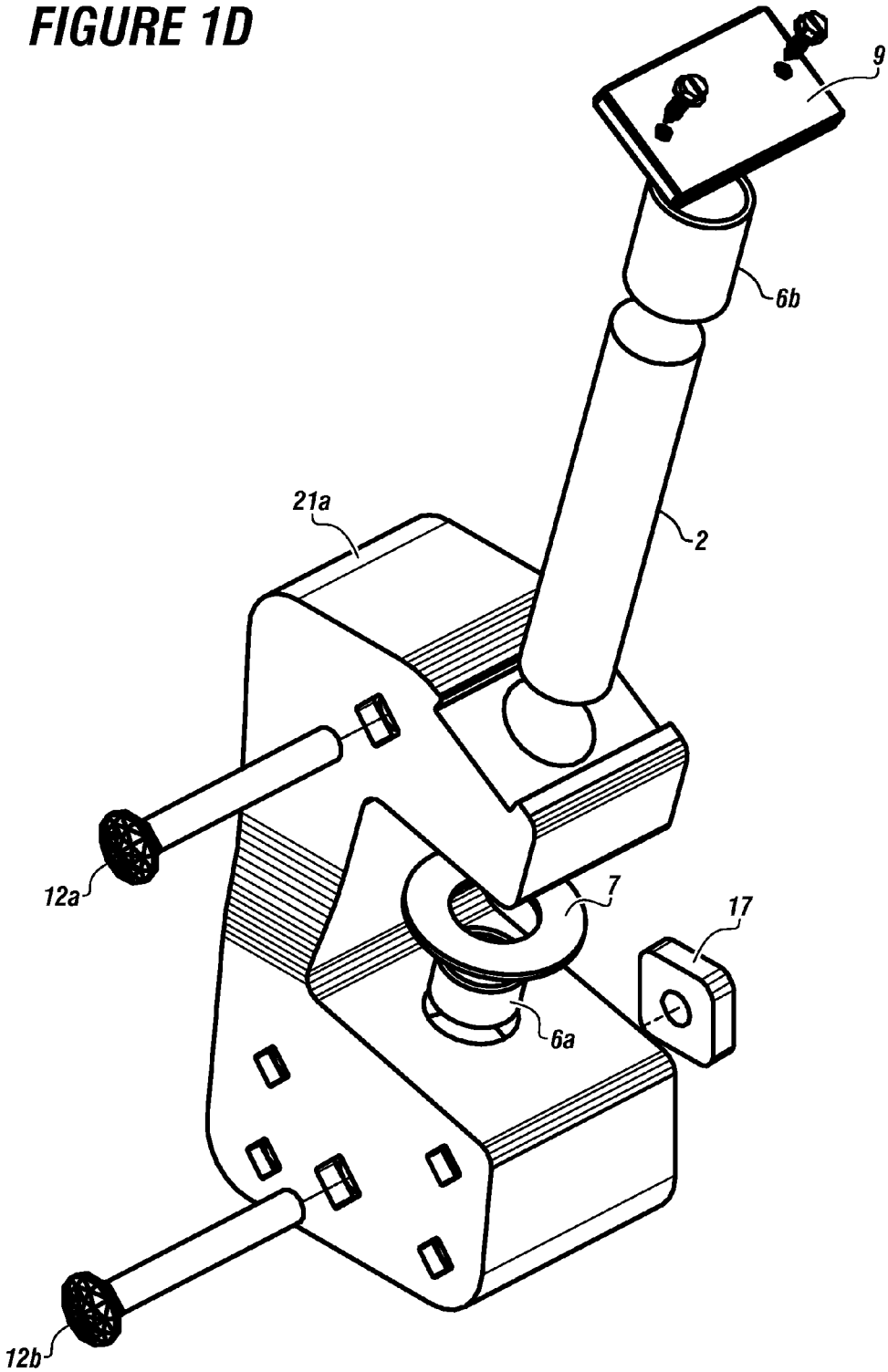
FIG. 1D depicts a perspective exploded view of the universal swing hinge assembly with fasteners according to one or more embodiments.

Turning now to the Figures, FIG. 1A depicts a perspective view of the universal swing hinge assembly according to one or more embodiments, FIG. 1B depicts a side view of the universal swing hinge assembly with a hinge pin and cover plate according to one or more embodiments, FIG. 1C depicts a front view of the universal swing hinge assembly according to one or more embodiments, and FIG. 1D depicts a perspective exploded view of the universal swing hinge assembly with fasteners and the hinge pin.

The universal swing hinge assembly 21*a* can include an upper hinge portion 56.

A hinge pin thru hole 34 can be disposed through the upper hinge portion 56 along a hinge axis 63. The hinge axis 63 can be at a first angle 59*a* from a hinge assembly axis 61 of the universal swing hinge assembly 21*a*.

In one or more embodiments, the hinge pin thru hole 34 can have a diameter ranging from about ¼ of an inch to about 4 inches.

The universal swing hinge assembly 21*a* can include a back portion 50.

The back portion 50 can be connected between the upper hinge portion 56 and a lower hinge portion 58.

A hole 40 can be formed into the lower hinge portion 58. The hole 40 can be axially aligned with the hinge pin thru hole 34. In one or more embodiments, the hole 40 can extend only partially into the lower hinge portion 58 or the hole 40 can extend through the lower hinge portion 58.

The hole 40 can have a diameter that is equal to or different than a diameter of the hinge pin thru hole 34. In one or more embodiments, the hole 40 can have a diameter ranging from about ¼ of an inch to about 4 inches, and a depth ranging from about ¼ of an inch to about 4 inches.

In one or more embodiments, a first bushing 6*a* can be disposed within the hole 40, and a wear plate 7 can be disposed over the first bushing 6*a* and engaged with an angled hinge face 46*a*. The hinge pin 2 can be disposed through the wear plate 7 and at least partially in the first bushing 6*a*.

One or more embodiments can include a second bushing 6*b* disposed in the hinge pin thru hole 34 and about the hinge pin 2. The first bushing 6*a*, second bushing 6*b*, and wear plate 7 can each be made of fluorinated ethylene polymer, tetrafluroethlyene polymer, TEFLON®, or the like.

The cover plate 9 can be engaged over the second bushing 6*b* and the hinge pin 2.

A recess 57*a* can be formed in the universal swing hinge assembly 21*a* between the upper hinge portion 56 and the lower hinge portion 58.

The recess 57*a* can include the angled hinge face 46*a* disposed at a second angle 59*b* from the hinge assembly axis 61, such that, when installed on the guardrail, a height of the angled hinge face 46*a* increases from an opening of the recess 57*a* towards the back portion 50. For example, the angled hinge face 46*a* can have a first height 47*a* that is less than a second height 47*b*.

The hinge axis 63 can extend perpendicular to the angled hinge face 46*a*. In one or more embodiments, the hinge assembly axis 61 can extend perpendicular to the surface that the guardrail is attached to.

In one or more embodiments, the first angle 59*a* can be oblique to the surface that the guardrail is attached to and can range from about greater than 0 degrees to less than 90 degrees. The second angle 59*b* can be oblique to the surface that the guardrail is attached to and can range from greater than 0 degrees to less than 90 degrees.

The hole 40 can be formed through the angled hinge face 46*a* into the lower hinge portion 58.

In one or more embodiments, the upper hinge portion 56, back portion 50, and lower hinge portion 58 can be a one-piece construction. The upper hinge portion 56, back portion 50, and lower hinge portion 58 can be made of polyurethane, another polymer, or another material.

The back portion 50 can have a back surface 53.

The upper hinge portion 56 can have a top 30 contiguous with the back surface 53.

A cover plate slot 32 can be formed in the top 30. In one or more embodiments, the top 30 can include a top angled surface 31, and the cover plate slot 32 can be formed into the top angled surface 31.

The hinge pin thru hole 34 can be formed through the top angled surface 31 in the cover plate slot 32.

The cover plate 9 can be slidably engaged in the cover plate slot 32 for covering the hinge pin 2. In one or more embodiments, the hinge pin 2 can be straight or tapered on one or both ends.

One or more cover plate fasteners 10*a* and 10*b* can removably secure the cover plate 9 within the cover plate slot 32 over the hinge pin 2. The cover plate fasteners 10*a* and 10*b* can be bolts, screws, or the like.

A front top surface 38 can be contiguous with the top 30, such as with the top angled surface 31.

The recess 57*a* can include a top inner hinge face 39*a* contiguous with the front top surface 38. A plane of the top inner hinge face 39*a* can extend parallel to a plane of the angled hinge face 46*a*.

The recess 57*a* can also include an inner hinge face 41*a* contiguous with the top inner hinge face 39*a*. The inner hinge face 41*a* can be contiguous with the top inner hinge face 39*a* and the angled hinge face 46*a*.

A top fillet 43 can be formed between the front top surface 38 and the inner hinge face 39*a*. In one or more embodiments, the front top surface 38 and the inner hinge face 39*a* can connect via a non-fillet corner.

The lower hinge portion 58 can include a front bottom surface 42 contiguous with the angled hinge face 46*a*.

A bottom fillet 44 can be formed between the front bottom surface 42 and the angled hinge face 46*a*. In one or more embodiments, the front bottom surface 42 and the angled hinge face 46*a* can connect via a non-fillet corner.

A bottom 48 can be contiguous with the front bottom surface 42 and the back surface 53.

The universal swing hinge assembly 21*a* can include a first side 60*a* perpendicular to and connected with the back surface 53, top 30, front top surface 38, top inner hinge face 39*a*, inner hinge face 41*a*, angled hinge face 46*a*, front bottom surface 42, and bottom 48.

The universal swing hinge assembly 21*a* can include a second side 60*b* perpendicular to and connected with back surface 53, top 30, front top surface 38, top inner hinge face 39*a*, inner hinge face 41*a*, angled hinge face 46*a*, front bottom surface 42, and bottom 48. The second side 60*b* can be disposed opposite and parallel to the first side 60*a*.

In one or more embodiments, the top 30 can have a top width 69 and the bottom 48 can have a bottom width 70. The bottom width 70 can be different than the top width 69. The angled hinge face 46*a* can have a width that is between the bottom width 70 and the top width 69.

When installed, the angled hinge face 46*a* can slope upwards from the guardrail opening in a first direction from the recess 57*a* towards the back portion 50. In embodiments with the bottom width 70 larger than the top width 69, when the universal swing hinge assembly 21*a* is installed onto the guardrail such that the second side 60*b* is substantially flush with the guardrail, the angled hinge face 46 can also slope upwards from the guardrail opening in a second direction. The lowest point on the slope of the angled hinge face 46*a* can be the neutral position.

One or more embodiments of the universal swing hinge assembly 21*a* can include a first hole 51*a* disposed through the upper hinge portion 56, a second hole 51*b* disposed through the lower hinge portion 58, and a plurality of pipe bolt holes 52*a*, 52*b*, 52*c*, and 52*d* disposed through the lower hinge portion 58.

A first fastener 12*a* can be disposed through the first hole 51*a* for engagement into the flat portion of a guardrail. The first fastener 12*a* can be a bolt.

A second fastener 12*b* can be disposed through the second hole 51*b* for engagement with the flat portion of a guardrail. The second fastener 12*b* can be a bolt. As such, the first fastener 12*a* and second fastener 12*b* can hold the universal swing hinge assembly 21*a* and the gravity-closing gate to the flat portion of the guardrail.

In one or more embodiments, each fastener 12*a* and 12*b* can be a screw, a carriage bolt, a bolt, a hex head bolt, a non-deforming bolt, a flat bolt, a bolt or screw made of metal or a non-deforming plastic, any fastener, or the like.

One or more embodiments can include a spacer 17, which can be disposed between the universal swing hinge assembly 21*a* and the flat portion of the guardrail. For example, if the guardrail is uneven, the spacer 17 can allow the universal swing hinge assembly 21*a* to engage flush with the guardrail. The spacer 17 can have a hole, such that the second fastener 12*b* or another fastener can pass through the spacer 17 for engagement with the guardrail.

The universal swing hinge assembly 21*a* can have a C-configuration with the upper hinge portion 56 and the lower hinge portion 58 each extending from the back portion 50.

The first side 60*a* or second side 60*b* can be engaged with the guardrail when the universal swing hinge assembly 21*a* is installed on the guardrail, such that upper hinge portion 56 and the lower hinge portion 58 both extend from the back portion 50 towards the guardrail opening, and such that the recess 57*a* opens towards the guardrail opening.

Figure 2A:
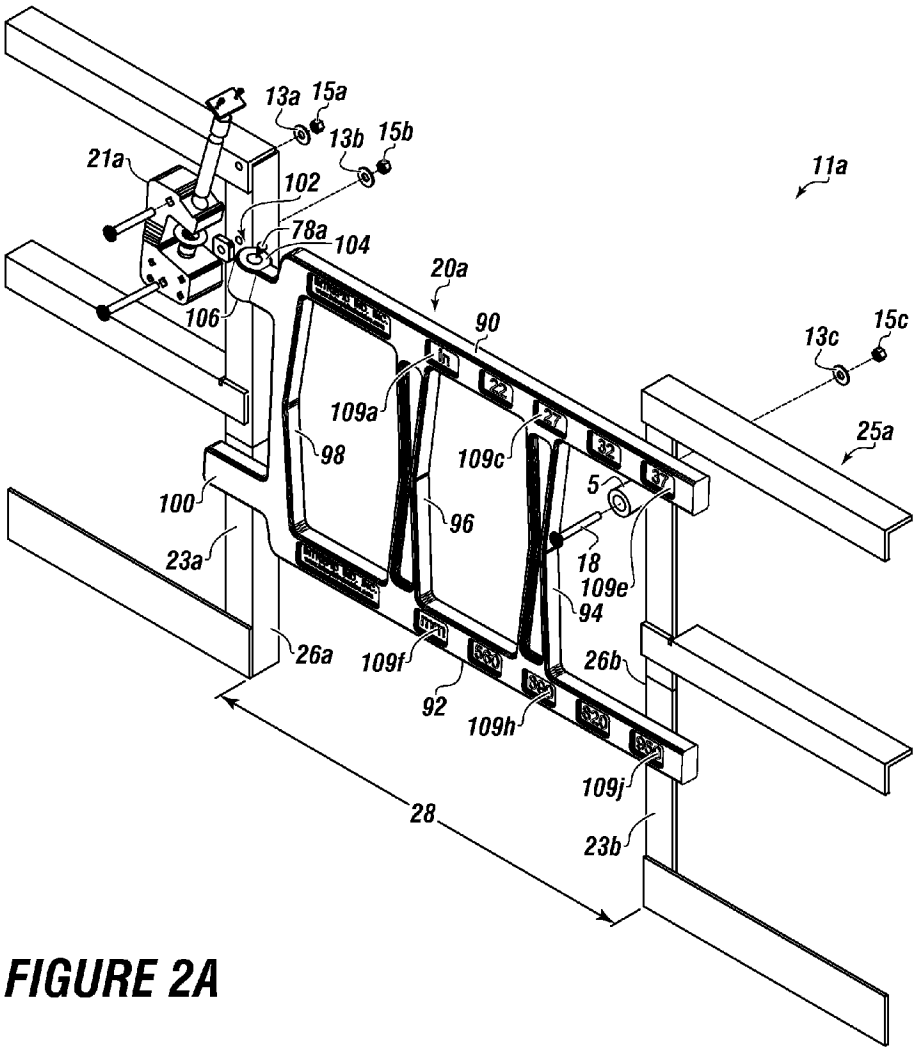
FIG. 2A depicts an exploded view of a universal swing hinge and gate assembly with the universal swing hinge assembly connecting a double bar gate to a flat portion of a guardrail according to one or more embodiments.
Figure 2B:
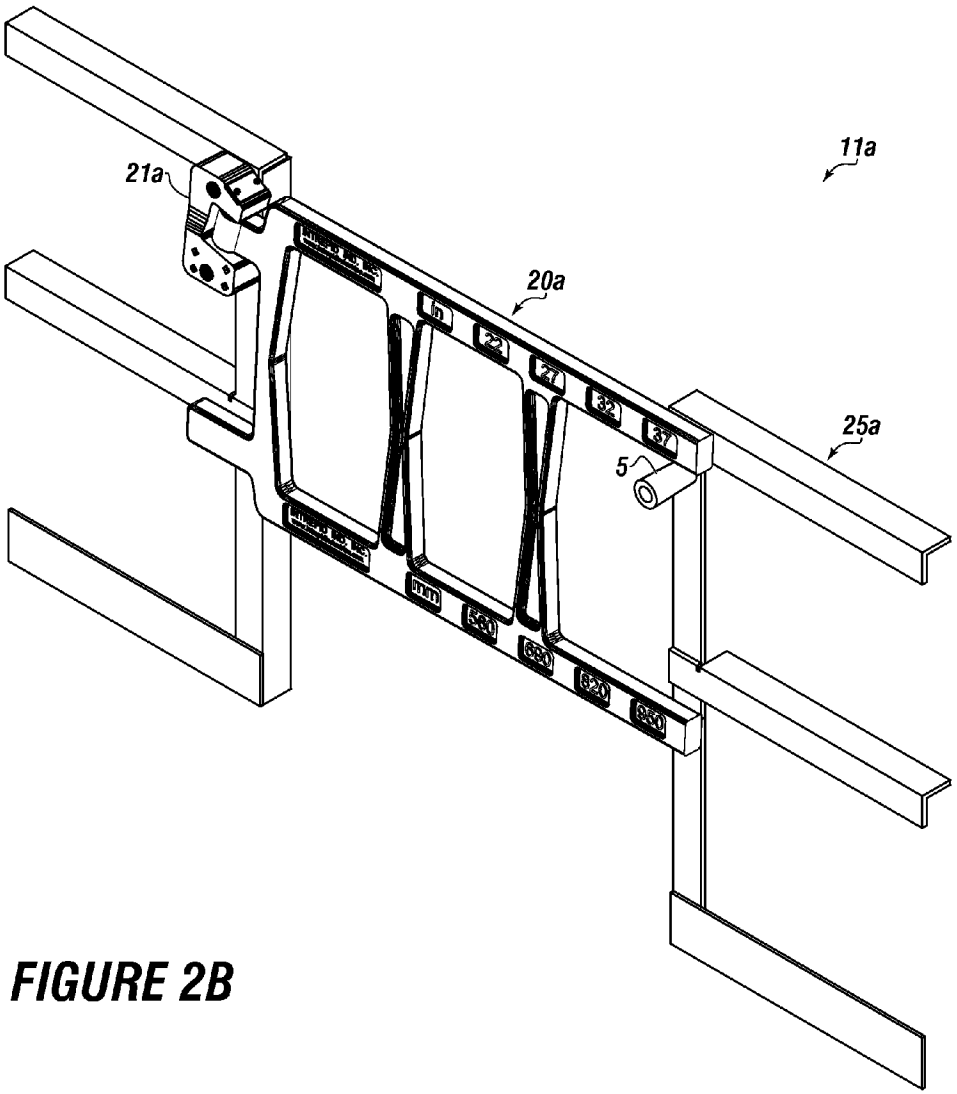
FIG. 2B depicts a perspective view of the universal swing hinge and gate assembly of FIG. 2A in a closed configuration.
Figure 2C:
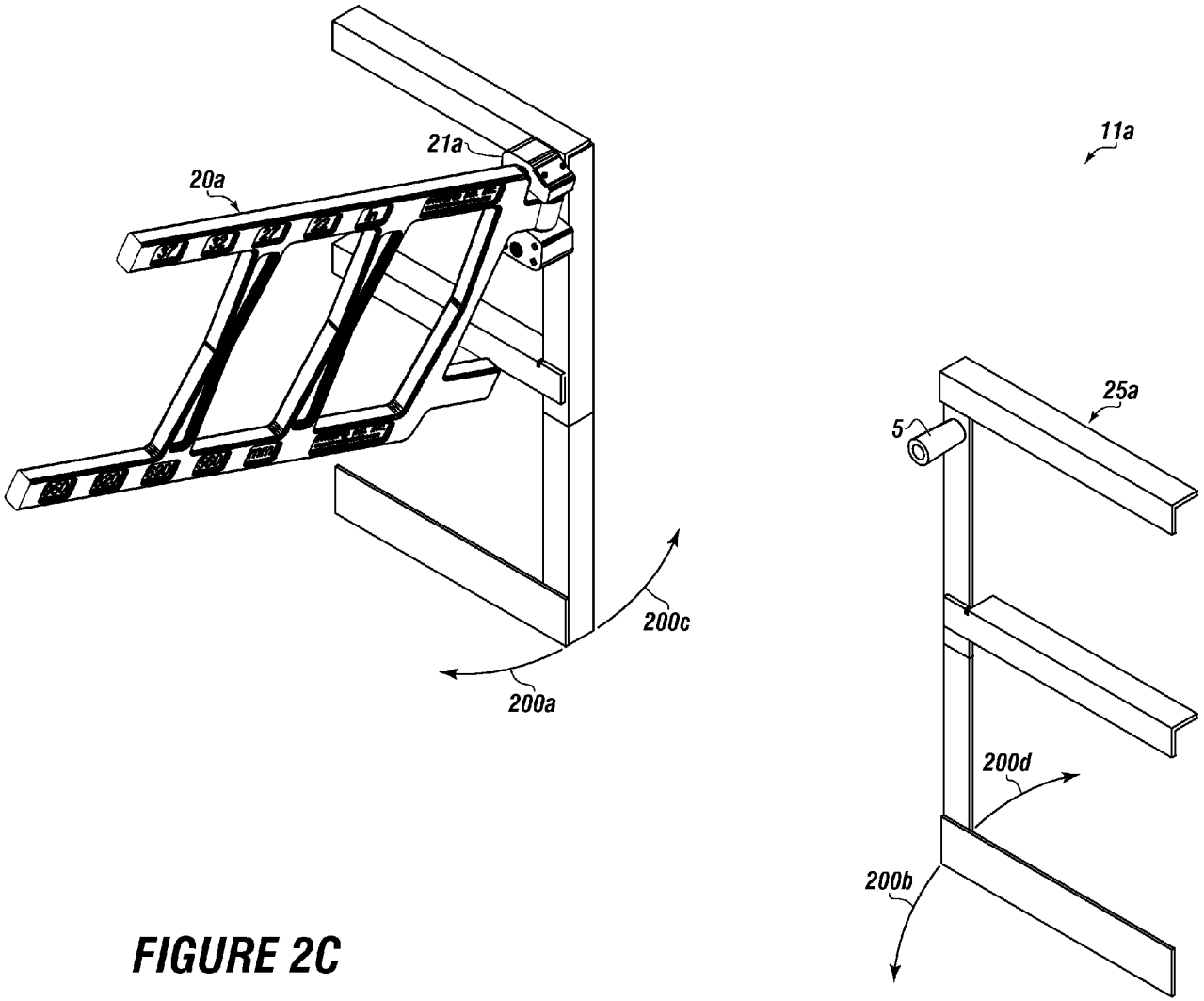
FIG. 2C depicts a perspective view of the universal swing hinge and gate assembly of FIG. 2A in an opened configuration.

FIG. 2A depicts an exploded view of a universal swing hinge and gate assembly with the universal swing hinge assembly connecting a double bar gravity-closing gate to a flat portion of a guardrail according to one or more embodiments, FIG. 2B depicts a perspective view of the universal swing hinge and gate assembly of FIG. 2A in a closed configuration, and FIG. 2C depicts a perspective view of the universal swing hinge and gate assembly of FIG. 2A in an opened configuration.

The universal swing hinge and gate assembly 11*a* can include a gravity-closing gate 20*a*, which can be a polymer gravity-closing gate.

A portion of the gravity-closing gate 20*a* can have a hinge pin hole 78*a* disposed therethrough.

The gravity-closing gate 20*a* can be engaged with the universal swing hinge assembly 21*a*. The hinge pin can be disposed through the hinge pin thru hole of the universal swing hinge assembly 21*a*, through the hinge pin hole 78*a*, and at least partially into the hole of the lower hinge portion; thereby attaching the gravity-closing gate 20*a* to the universal swing hinge assembly 21*a*.

The universal swing hinge assembly 21*a* can be configured to be attached to a guardrail 25*a* on a first side 26*a* or a second side 26*b* of a guardrail opening 28.

For example, the universal swing hinge assembly 21*a* can be configured to be attached to a flat portion 23*a* of the guardrail 25*a*; thereby attaching the gravity-closing gate 20*a* to the guardrail 25*a*. The universal swing hinge assembly 21*a* can be attached to the flat portion 23*a* via fasteners, which can be engaged with washers 13*a* and 13*b* and nuts 15*a* and 15*b*.

The recess of the universal swing hinge assembly 21*a* can be configured to open towards the guardrail opening 28.

The gravity-closing gate 20*a* can include a top bar 90, a bottom bar 92, and a first strut 98 connected between the top bar 90 and the bottom bar 92.

The gravity-closing gate 20*a* can have a length sufficient to engage the guardrail 25*a* on the second side 26*b* of the guardrail opening 28. For example, the top bar 90 and the bottom bar 92 can both configured to extend from the first strut 98 to the second side 26*b* and engage the guardrail 25*a* at the second side 26*b* for restraining movement therethrough.

The portion of the gravity-closing gate 20*a* with the hinge pin hole 78*a* can be disposed within the recess of the universal swing hinge assembly 21*a*. For example, the portion of the gravity-closing gate 20*a* with the hinge pin hole 78*a* can be a knob 102 connected with the first strut 98. The knob 102 can be configured to extend from the first strut 98 towards the first side 26*a* of the guardrail opening 28.

The knob 102 can include a knob top face 104 and a knob wear face 106 formed opposite the knob top face 104.

The knob 102 can be disposed within the recess of the universal swing hinge assembly 21*a*. The hinge pin hole 78*a* can be disposed through the knob 102 from the knob top face 104 to the knob wear face 106. In operation, the knob wear face 106 can rest on the wear plate.

One or more embodiments of the gravity-closing gate 20*a* can include a plurality of struts, such as the first strut 98, a second strut 96 connected between the top bar 90 and the bottom 92 and spaced apart from the first strut 96, and a third strut 94 connected between the top bar 90 and the bottom bar 92 and spaced apart from the first strut 98 and the second strut 96.

The universal swing hinge and gate assembly 11*a* can include a stopper 100 extending from the first strut 98. The stopper 100 can be configured to extend towards the first side 26*a* of the guardrail opening 28. In operation, the stopper 100 can prevent movement of the gravity-closing gate 20*a* beyond a preset limit.

The universal swing hinge and gate assembly 11*a* can include first distance indicators, such as 109*a*, 109*c*, and 109*e* disposed on the top bar 90.

The universal swing hinge and gate assembly 11*a* can include second distance indicators, such as 109*f*, 109*h*, and 109*j* disposed on the bottom bar 92.

The first distance indicators 109*a*, 109*c*, and 109*e* and the second distance indicators 109*f*, 109*h*, and 109*j* can each provide distance measurements in inches, millimeters, or the like.

The universal swing hinge and gate assembly 11*a* can include a support block 5 configured to be connected to the guardrail 25*a* on the second side 26*b* of the guardrail opening 28 below a portion of the gravity-closing gate 20*a*.

The support block 5 can be spaced apart from the portion of the gravity-closing gate 20*a* at the second side 26*b*, such that in normal operation the support block 5 is disengaged from the gravity-closing gate 20*a*.

The support block 5 can be configured to engage the portion of the gravity-closing gate 20*a* at the second side 26*b* to prevent the gravity-closing gate 20*a* from moving below the support block 5. For example, when a person falls on the gravity-closing gate 20*a*, the gravity-closing gate 20*a* can move towards the support block 5, and upon engagement of the support block 5 with the gravity-closing gate 20*a* the support block 5 can prevent further movement of the gravity-closing gate 20*a*.

A support block fastener 18 can be configured to connect the support block 5 to the guardrail 25*a*. For example, the support block fastener 18 can be a bolt engaged through the support block 5, through a flat portion 23*b* of the guardrail 25*a*, through a washer 13*c*, and with a nut 15*c*.

The flat portions 23*a* and 23*b* can be angle irons, metal plates, square tubular fiberglass members, flat composite members, or other structural members of the guardrail 25*a*.

The recess of the universal swing hinge assembly 21*a* can be configured to allow the gravity-closing gate 20*a* to swing on the hinge pin from engagement with the guardrail 25*a* in a closed configuration to an opened configuration.

In operation, the angled hinge face of the universal swing hinge assembly 21*a* can cause the gravity-closing gate 20*a* to rise away from the neutral position on the angled hinge face when the gravity-closing gate 20*a* is opening, and to return and close towards the neutral position on the angled hinge face when the gravity-closing gate 20*a* is disposed in an at least partially opened configuration. As such, the gravity-closing gate 20*a* can be attached to either side of the guardrail 25*a* and can automatically close via gravity.

The gravity-closing gate 20*a* can rest at the lowest neutral position on the slope of the angled hinge face when in the closed configuration.

The universal swing hinge assembly 21*a* can be attached to either the first side 26*a* or the second side 26*b* of the guardrail opening 28 without requiring disassembly of the gravity-closing gate 20*a* from the universal swing hinge assembly 21*a* by selectively attaching the universal swing hinge assembly 21*a* to the guardrail 25*a* using fasteners.

Depending upon where the universal swing hinge assembly 21*a* is attached, the gravity-closing gate 20*a* can swing opened and closed along a first arc 200*a*, a second arc 200*b*, a third arc 200*c*, or a fourth arc 200*d*.

When the universal swing hinge assembly 21*a* is uninstalled from the guardrail 25*a*, the universal swing hinge assembly 21*a* can be configured to allow the gravity-closing gate 20*a* to rotate about the hinge axis by at least 90 degrees in either direction from the lowest neutral position; thereby allowing the gravity-closing gate 20*a* to swing opened and closed along the first arc 200*a*, second arc 200*b*, third arc 200*c*, or fourth arc 200*d*.

Figure 3A:
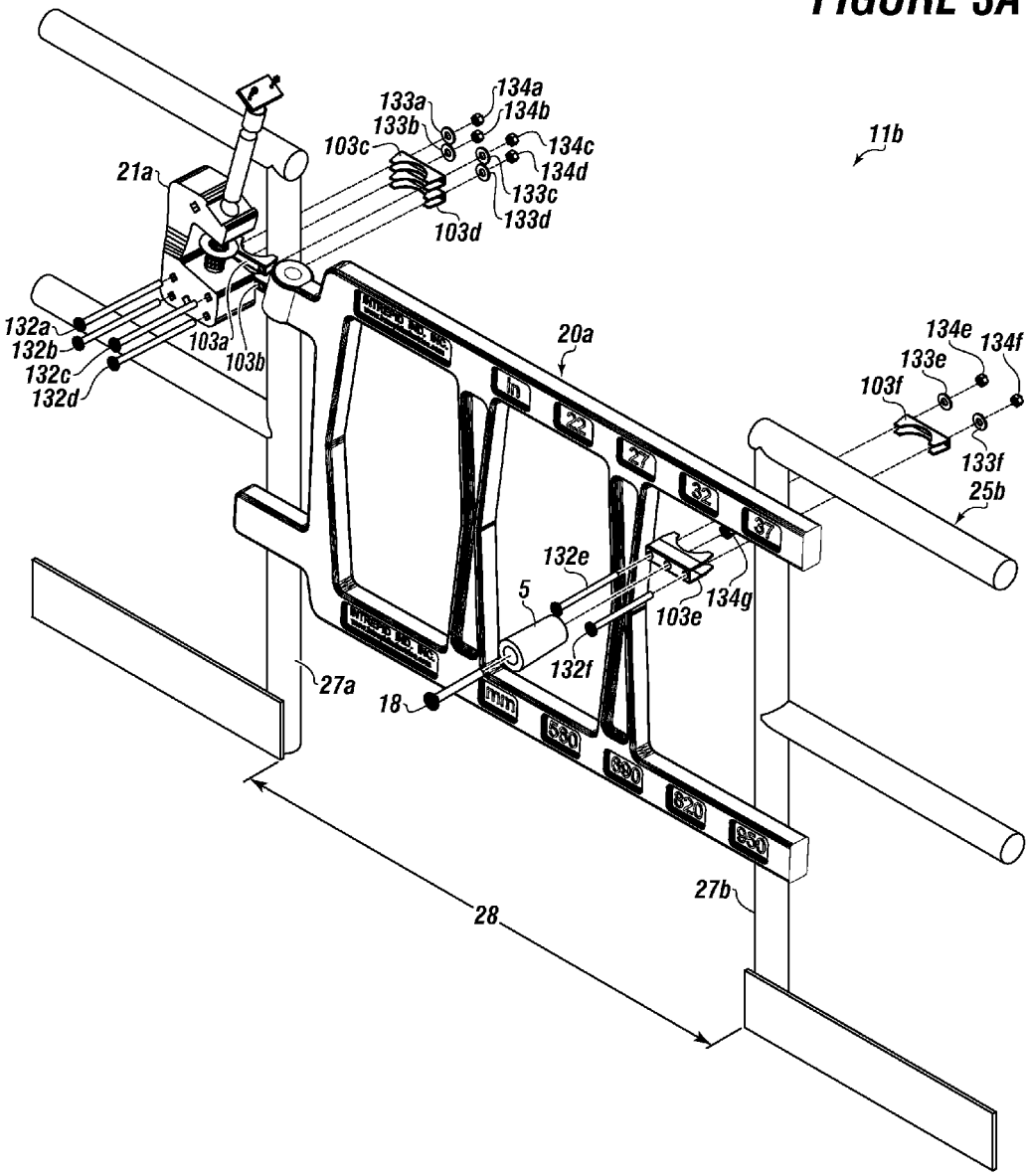
FIG. 3A depicts an exploded view of the universal swing hinge and gate assembly with the universal swing hinge assembly connecting a double bar gate to a rounded portion of a guardrail according to one or more embodiments.
Figure 3B:
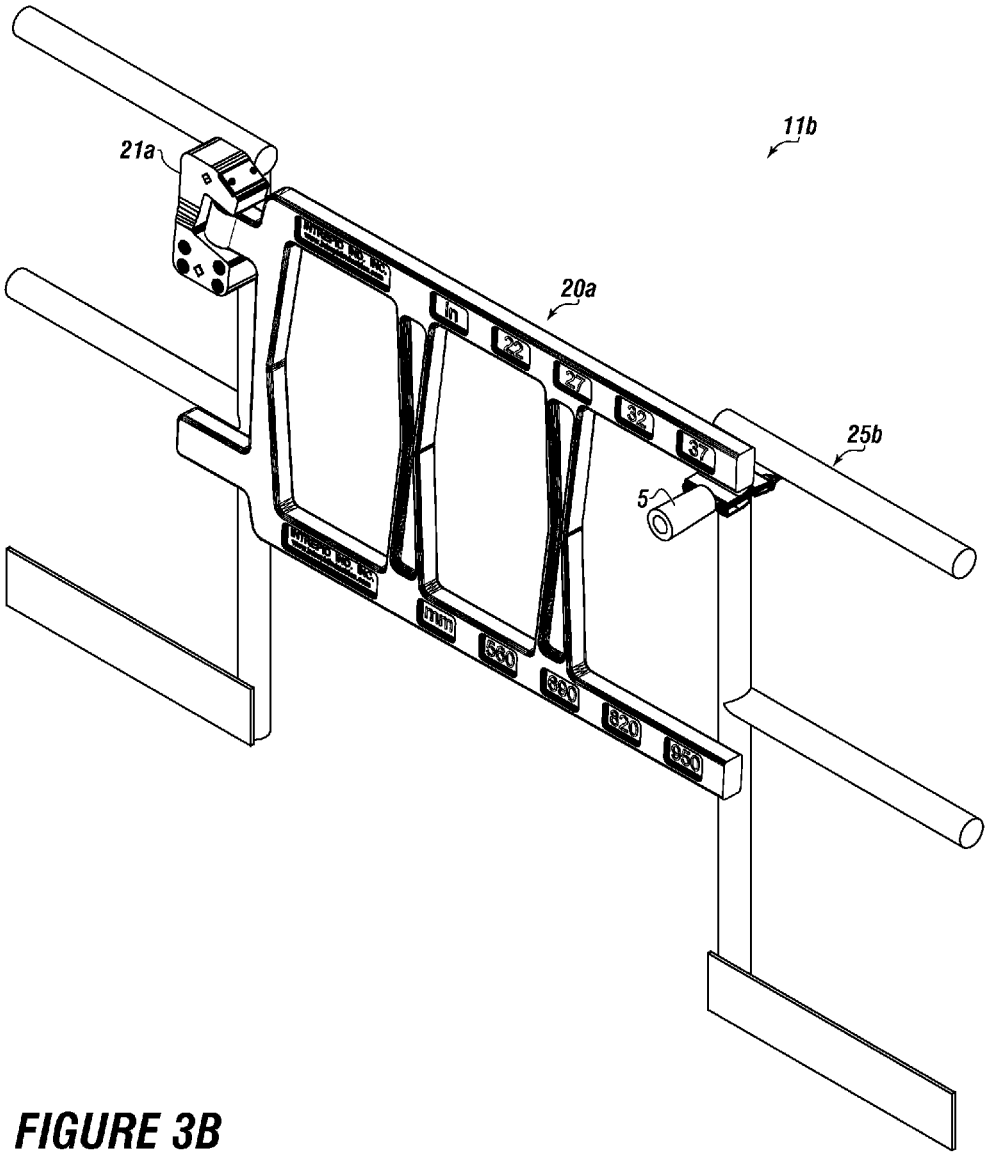
FIG. 3B depicts a perspective view of the universal swing hinge and gate assembly of FIG. 3A in a closed configuration.

FIG. 3A depicts an exploded view of a universal swing hinge and gate assembly including a double bar gravity-closing gate connected to a rounded portion of a guardrail according to one or more embodiments, and FIG. 3B depicts a perspective view of the universal swing hinge and gate assembly of FIG. 3A in a closed configuration.

The universal swing hinge and gate assembly 11*b* can include the gravity-closing gate 20*a* engaged with the universal swing hinge assembly 21*a*.

The universal swing hinge assembly 21*a* can be configured to attach the gravity-closing gate 20*a* to a rounded portion 27*a* of the guardrail 25*b*.

One or more clamps 103*a*, 103*b*, 103*c*, and 103*d* can be disposed around the rounded portion 27*a* of the guardrail 25*b* on the first side of the guardrail opening 28.

A plurality of pipe bolts 132*a*, 132*b*, 132*c*, and 132*d* can be inserted through the plurality of pipe bolt holes of the universal swing hinge assembly 21*a*.

The plurality of pipe bolts 132*a*-132*d* can be engaged through the clamps 103*a*-103*d*; adjacent to the rounded portion 27*a*; through pipe bolt washers 133*a*, 133*b*, 133*c*, and 133*d*; and with pipe bolt nuts 134*a*, 134*b*, 134*c*, and 134*d*.

As such, the plurality of pipe bolts 132*a*-132*d* and clamps 103*a*-103*d* can hold the universal swing hinge assembly 21*a* and the gravity-closing gate 20*a* to the rounded portion 27*a* of the guardrail 25*b*.

The support block 5 can include the support block fastener 18, which can be a bolt engaged with clamp 103*e* and a pipe bolt nut 134*g*.

The clamp 103*e* and a clamp 103*f* can be engaged about a rounded portion 27*b* of the guardrail 25*b* on the second side.

Pipe bolts 132*e* and 132*f* can be engaged through the clamps 103*e* and 103*f*, through pipe bolt washers 133*e* and 133*f*, and with pipe bolt nuts 134*e* and 134*f*.

The universal swing hinge assembly 21*a* can be attached to either the first side or the second side of the guardrail opening 28 without requiring disassembly of the gravity-closing gate 20*a* from the universal swing hinge assembly 21*a* by selectively attaching the universal swing hinge assembly 21 using fasteners and clamps.

Figure 4:
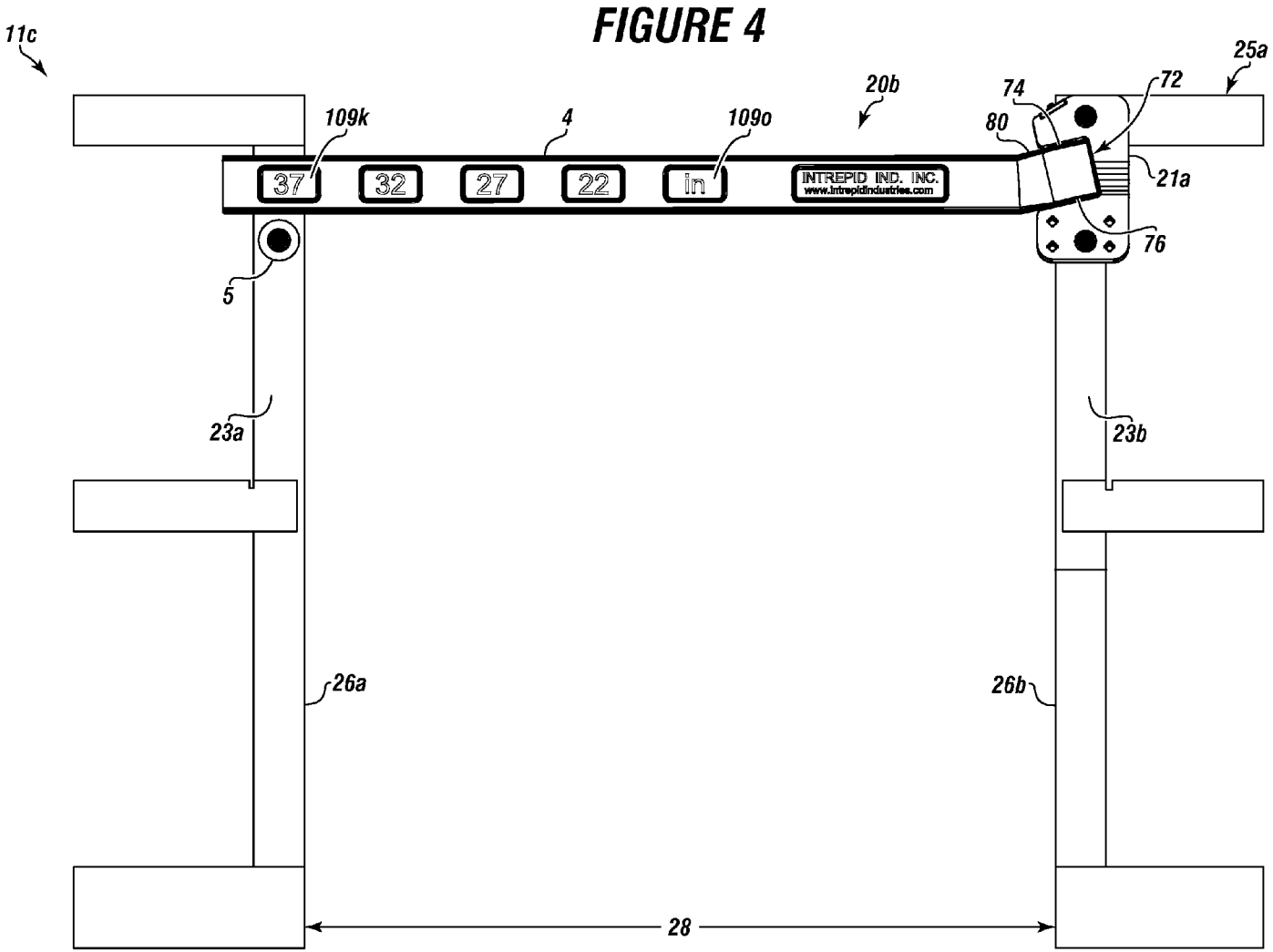
FIG. 4 depicts the universal swing hinge and gate assembly with the universal swing hinge assembly connecting a single bar gravity-closing gate to a right side of a flat portion of a guardrail according to one or more embodiments.

FIG. 4 depicts the universal swing hinge and gate assembly with a single bar gravity-closing gate connected to one side of a flat portion of a guardrail according to one or more embodiments.

The universal swing hinge and gate assembly 11*c* can include a single bar gravity-closing gate 20*b* connected with the universal swing hinge assembly 21*a*.

The universal swing hinge assembly 21*a* can be configured to attach the single bar gravity-closing gate 20*b* to the flat portion 23*b* of the guardrail 25*a* at the second side 26*b* of the guardrail opening 28, or attach the single bar gravity-closing gate 20*b* to the flat portion 23*a* of the guardrail 25*a* at the first side 26*a* of the guardrail opening 28. As such, the single bar gravity-closing gate 20*b* can be attached to swing open to the left or right.

The single bar gravity-closing gate 20*b* can include a knob portion 72, which can be the portion of the single gravity-closing gate 20*b* having the hinge pin hole disposed therethrough.

The knob portion 72 can have a top face 74, a bottom face 76 opposite the top face 74, and a tapered portion 80 extending from the top face 74 and the bottom face 76. The hinge pin hole can be disposed through the knob portion 72 from the top face 74 to the bottom face 76.

The hinge pin can be simultaneously engaged through the hinge pin thru hole of the universal swing hinge assembly 21*a*, through the hinge pin hole, and into the hole of lower hinge portion.

The tapered portion 80 can be connected with a bar 4. The bar 4 can extend from the knob portion 72 at the second side 26*b*, across the guardrail opening 28, and past the first side 26*a* of the guardrail opening 28 to engage with the flat portion 23*a* of the guardrail 25*a* for restraining movement through the guardrail opening 28.

The bar 4 can have one or more distance indicators, such as 109*k* and 109*o*, disposed thereon for indicating a distance along the bar 4.

In operation, when the universal swing hinge assembly 21*a* is attached to the first side 26*a* of the guardrail opening 28, the universal swing hinge assembly 21*a* can allow the single bar gravity-closing gate 20*b* to only swing open towards the first side 26*a* of the guardrail opening 28, and to only swing closed towards the second side 26*b* of the guardrail opening 28. When the universal swing hinge assembly 21*a* is attached to the second side 26*b* of the guardrail opening 28, as shown, the universal swing hinge assembly 21*a* can allow the single bar gravity-closing gate 20*b* to only swing open towards the second side 26*b* of the guardrail opening 28, and to only swing closed towards the first side 26*a* of the guardrail opening 28.

Each gravity-closing gate disclosed herein can be attached to the first side 26*a* of the guardrail opening 28 by attaching the universal swing hinge assembly 21*a* to the first side 26*a* of the guardrail opening 28, or to the second side 26*b* of the guardrail opening 28 by attaching the universal swing hinge assembly 21*a* to the second side 26*b* of the guardrail opening 28.

The support block 5 can be attached to the first side 26*a* of the guardrail 25*a* below the bar 4.

The single bar gravity-closing gate 20*b* can also be attached to rounded portions of guardrails via the universal swing hinge assembly 21*a* and one or more clamps as disclosed herein.

Figure 5:
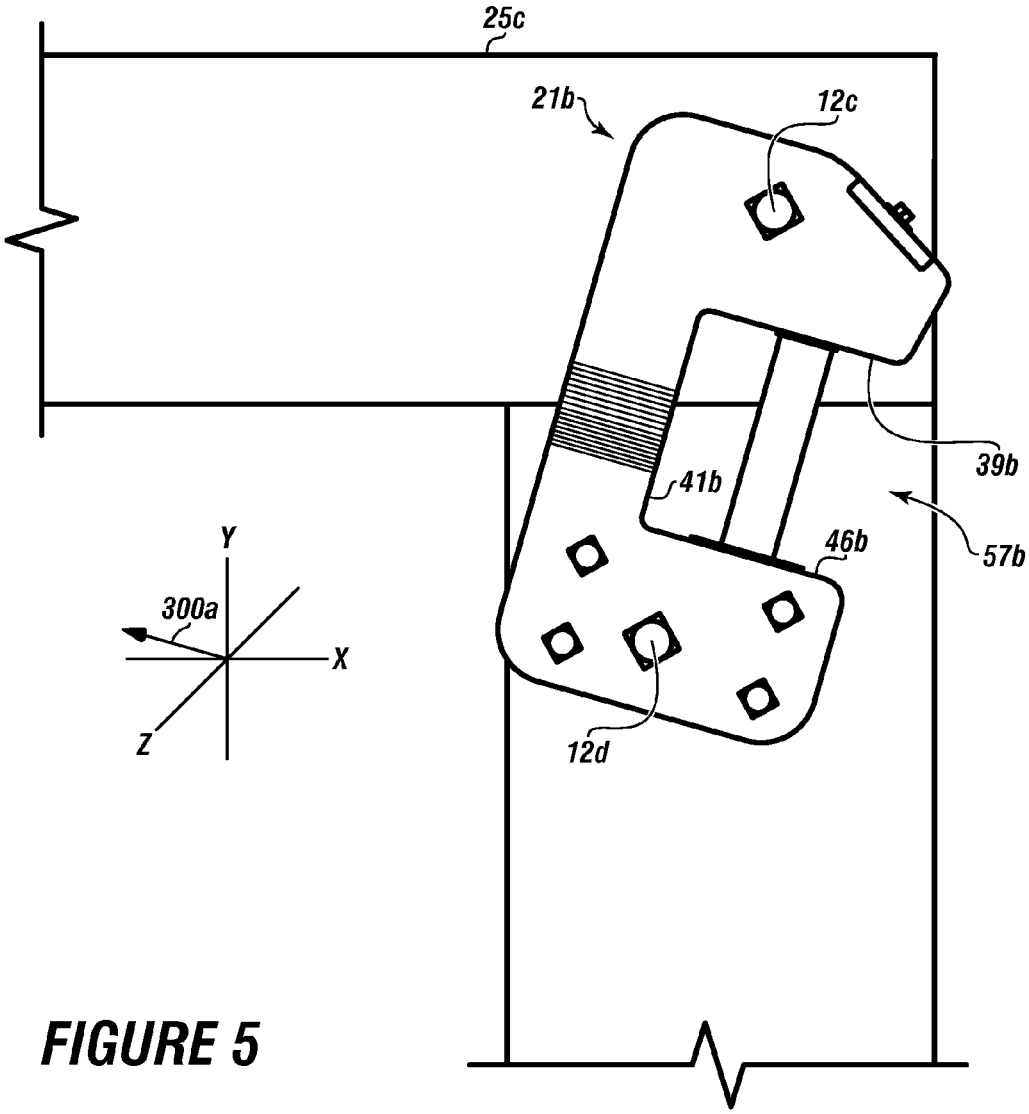
FIG. 5 depicts an embodiment of the universal swing hinge assembly installed at an angle.

FIG. 5 depicts another embodiment of the universal swing hinge assembly.

The universal swing hinge assembly 21*b* can include a recess 57*b* formed with straight sides. For example, the top inner hinge face 39*b* and angled hinge face 46*b* can be disposed perpendicular to the hinge assembly axis, and the inner hinge face 41*b* can be disposed perpendicular to the top inner hinge face 39*b* and angled hinge face 46*b*, such that a plane of the inner hinge face 41*b* extends along the hinge assembly axis.

The universal swing hinge assembly 21*b* can be installed at a tilt on the guardrail 25*c* via fasteners 12*c* and 12*d*, such that the angled hinge face 46*b* slopes upwards away from the guardrail opening. For example, the angled hinge face 46*b* can have a slope 300*a* between an x-axis and a y-axis that increases as it moves away from the guardrail opening.

Figure 6B:
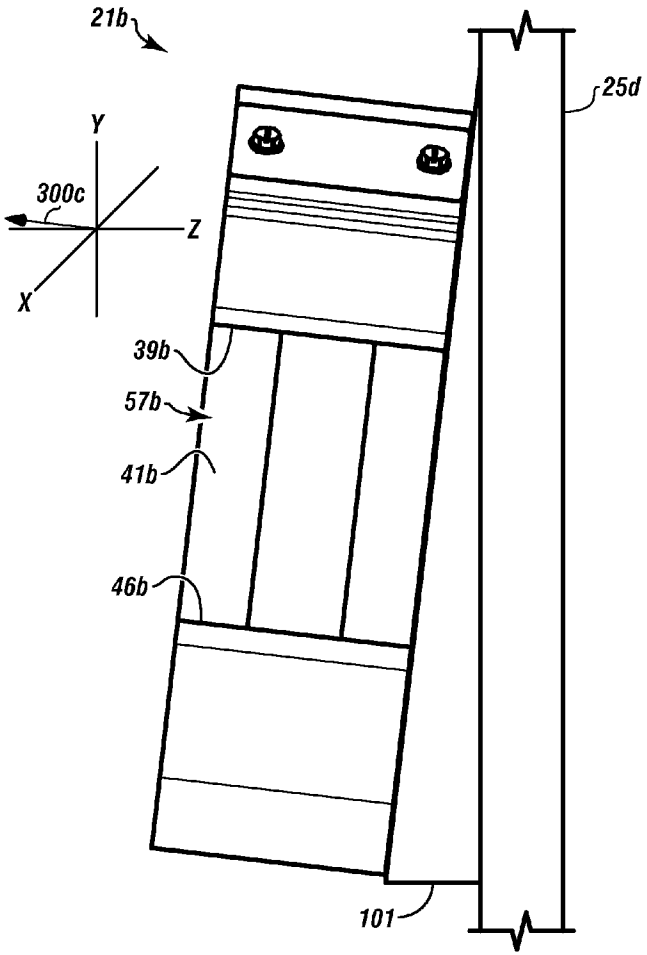
FIG. 6B depicts an embodiment of the universal swing hinge assembly installed with a wedge.
Figure 6A:
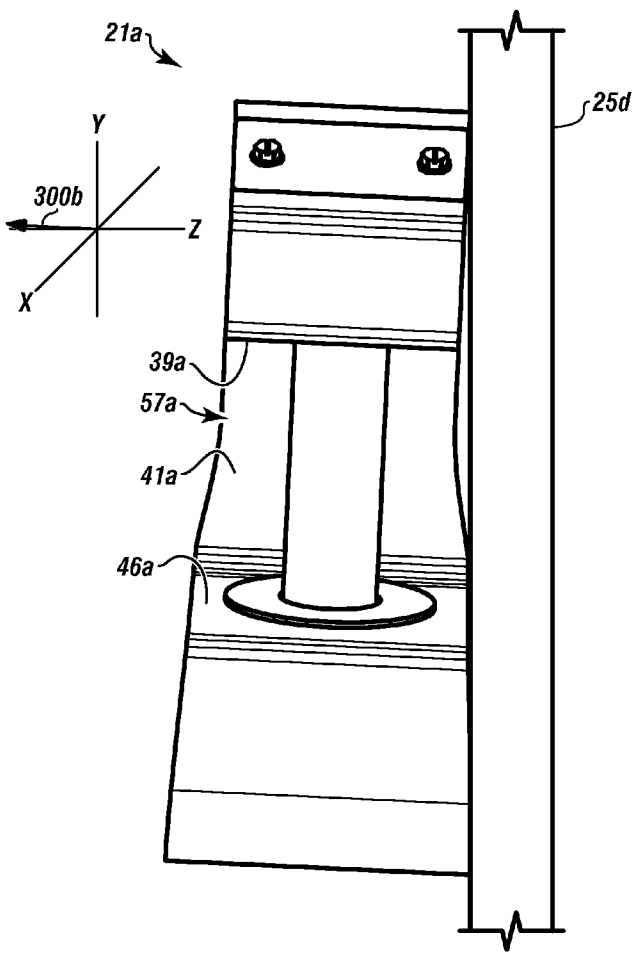
FIG. 6A depicts an embodiment of the universal swing hinge assembly with an integrated wedge.

FIG. 6A depicts an embodiment of the universal swing hinge assembly with an integrated wedge.

The universal swing hinge assembly 21*a* can include the recess 57*a* formed with angled sides, including the top inner hinge face 39*a*, the angled hinge face 46*a*, and the inner hinge face 41*a*.

An integrated wedge can be formed with the universal swing hinge assembly 21*a* via the bottom width being larger than the top width. As such, when the universal swing hinge assembly 21*a* is installed on the guardrail 25*d* it can be disposed at a tilt.

The angled hinge face 46*a* can slope upwards away from the guardrail opening in the first direction with the first slope as described in FIG. 5, as well as in a second direction between the y-axis and the z-axis with a second slope 300*b*.

FIG. 6B depicts an embodiment of the universal swing hinge assembly installed with a wedge.

The universal swing hinge assembly 21*b* can include the recess 57*b* formed with straight sides, including the top inner hinge face 39*b* and angled hinge face 46*b* disposed perpendicular to the hinge assembly axis, as well as the inner hinge face 41*b* disposed perpendicular to the top inner hinge face 39*b* and angled hinge face 46*b*.

The universal swing hinge assembly 21*b* can be installed on the guardrail 25*d* with a wedge member 101, such that the angled hinge face 46*b* slopes upwards away from the guardrail opening.

The angled hinge face 46*b* can slope upwards away from the guardrail opening in the second direction with a third slope 300*c* between the y-axis and the z-axis.

While these embodiments have been described with emphasis on the embodiments, it should be understood that within the scope of the appended claims, the embodiments might be practiced other than as specifically described herein.

What is claimed is:

1. A universal swing hinge and gate assembly comprising:

a. a gravity-closing gate, wherein a portion of the gravity-closing gate comprises a hinge pin hole disposed therethrough;

b. a universal swing hinge assembly configured to be selectively attached to a guardrail on a first side of a guardrail opening or a second side of the guardrail opening and allow the gravity-closing gate to open in either direction by rising from a lowest neutral position, wherein the universal swing hinge assembly comprises:

(i) an upper hinge portion comprising a hinge pin thru hole;

(ii) a back portion connected between the upper hinge portion and a lower hinge portion, wherein the lower hinge portion comprises a hole formed therethrough, and wherein the hole is axially aligned with the hinge pin thru hole; and (iii) a recess formed in the universal swing hinge assembly between the upper hinge portion and the lower hinge portion, wherein the recess comprises an angled hinge face sloping upwards from the guardrail opening in one or more directions, and wherein the recess is configured to open towards the guardrail opening and receive a portion of the gravity-closing gate;

c. a hinge pin disposed through the hinge pin thru hole, through the hinge pin hole, and at least partially into the hole, thereby attaching the gravity-closing gate to the universal swing hinge assembly; and d. whereby the angled hinge face causes the gravity-closing gate to rise in either direction away from the lowest neutral position on the angled hinge face when the gravity-closing gate is opening, and to return in either direction towards the lowest neutral position on the angled hinge face when the gravity-closing gate is closing, thereby allowing the universal swing hinge and gate assembly to be attached to either side of the guardrail opening.

2. The universal swing hinge and gate assembly of claim 1, wherein the hinge pin thru hole is disposed through the upper hinge portion along a hinge axis, wherein the hinge axis is at a first angle from a hinge assembly axis of the universal swing hinge assembly, wherein the angled hinge face is disposed at a second angle from the hinge assembly axis, and wherein the hinge axis is perpendicular to the angled hinge face.

3. The universal swing hinge and gate assembly of claim 2, wherein the first angle is oblique to the hinge assembly axis, and wherein the second angle is oblique to the hinge assembly axis.

4. The universal swing hinge and gate assembly of claim 1, wherein the portion of the gravity-closing gate comprising the hinge pin hole is a knob portion comprising a top face, a bottom face opposite the top face, and tapered portion extending from the top face and the bottom face and connected with a bar, wherein the hinge pin hole is disposed through the knob portion from the top face to the bottom face, and wherein the bar extends from the knob portion across the guardrail opening and engages the guardrail on the side of the guardrail opening opposite the universal swing hinge assembly for restraining movement through the guardrail opening.

5. The universal swing hinge and gate assembly of claim 4, wherein the bar comprises a distance indicator disposed thereon for indicating a distance along the bar.

6. The universal swing hinge and gate assembly of claim 1, wherein the gravity-closing gate comprises:

a. a top bar;

b. a bottom bar;

c. a first strut connected between the top bar and the bottom bar, wherein the top bar and the bottom bar are both configured to extend from the first strut to the side of the guardrail opening opposite the universal swing hinge assembly and engage the guardrail for restraining movement through the guardrail opening; and d. a knob connected with the first strut, wherein the knob is configured to extend from the first strut towards the side of the guardrail opening that the universal swing hinge assembly is attached to, and wherein the knob comprises:

(i) a knob top face; and (ii) a knob wear face formed opposite the knob top face, wherein the knob is disposed within the recess, and wherein the hinge pin hole is disposed through the knob from the knob top face to the knob wear face.

7. The universal swing hinge and gate assembly of claim 6, further comprising:

a. a second strut connected between the top bar and the bottom bar, wherein the second strut is spaced apart from the first strut; and b. a third strut connected between the top bar and the bottom bar, wherein the third strut is spaced apart from the first strut and the second strut.

8. The universal swing hinge and gate assembly of claim 6, further comprising a stopper extending from the first strut, wherein the stopper is configured to extend towards the side of the guardrail opening that the universal swing hinge assembly is attached to, and wherein the stopper prevents movement of the gate beyond a preset limit.

9. The universal swing hinge and gate assembly of claim 6, further comprising distance indicators disposed on the top bar and the bottom bar.

10. The universal swing hinge and gate assembly of claim 1, further comprising a support block configured to be connected to the guardrail on the side of the guardrail opening opposite the universal swing hinge assembly, below a portion of the gravity-closing gate and spaced apart from the portion of the gravity-closing gate, wherein the support block is configured to engage the portion of the gravity-closing gate to prevent the gravity-closing gate from moving below the support block.

11. The universal swing hinge and gate assembly of claim 1, wherein the hinge pin is straight or tapered on one or both ends.

12. The universal swing hinge and gate assembly of claim 1, further comprising a bushing disposed within the hole, wherein the hinge pin is disposed at least partially in the bushing.

13. The universal swing hinge and gate assembly of claim 12, further comprising a wear plate disposed over the bushing and engaged with the angled hinge face, wherein the hinge pin is disposed through the wear plate.

14. The universal swing hinge and gate assembly of claim 13, wherein the bushing and the wear plate each comprise a material selected from a member from the group consisting of: fluorinated ethylene polymer, tetrafluroethylene polymer, TEFLON®, and combinations thereof.

15. The universal swing hinge and gate assembly of claim 12, further comprising a second bushing disposed in the hinge pin thru hole.

16. The universal swing hinge and gate assembly of claim 1, wherein:

a. the back portion comprises a back surface;

b. the upper hinge portion further comprises:

(i) a top having a top width, wherein the top is contiguous with the back surface;

(ii) a cover plate slot formed in the top, wherein the hinge pin thru hole is formed through the top in the cover plate slot;

(iii) a cover plate slidably engaged in the cover plate slot for covering the hinge pin; and (iv) a front top surface contiguous with the top;

c. the recess further comprises:

(i) a top inner hinge face contiguous with the front top surface;

(ii) an inner hinge face contiguous with the top inner hinge face and the angled hinge face; and (iii) a top fillet formed between the front top surface and the inner hinge face;

d. the lower hinge portion further comprises:

(i) a front bottom surface contiguous with the angled hinge face, wherein the hole is formed through the angled hinge face into the lower hinge portion;

(ii) a bottom fillet formed between the front bottom surface and the angled hinge face; and (iii) a bottom contiguous with the front bottom surface and the back surface, wherein the bottom has a bottom width, and wherein the bottom width is larger than the top width; and e. the universal swing hinge assembly further comprises:

(i) a first side perpendicular to and connected with the back surface, the top, the front top surface, the top inner hinge face, the inner hinge face, the angled hinge face, the front bottom surface, and the bottom; and (ii) a second side perpendicular to and connected with the back surface, the top, the front top surface, the top inner hinge face, the inner hinge face, the angled hinge face, the front bottom surface, and the bottom, wherein the second side is disposed opposite and parallel to the first side.

17. The universal swing hinge and gate assembly of claim 1, wherein the angled hinge face slopes upwards from the guardrail opening in a first direction, and wherein the upper hinge portion has a width that is less than a width of the lower hinge portion, thereby allowing the universal swing hinge assembly to the slope upwards from the guardrail opening in a second direction when installed thereon.

18. The universal swing hinge and gate assembly of claim 1, wherein:

a. the universal swing hinge assembly is configured to attach the gravity-closing gate to a flat portion of the guardrail, wherein the universal swing hinge assembly further comprises: one or more holes disposed through the upper hinge portion, the lower hinge portion, or combinations thereof, wherein the one or more holes are configured to receive one or more fasteners for engaging into the flat portion of the guardrail, thereby holding the universal swing hinge assembly and the gravity-closing gate to the flat portion of the guardrail; and b. the universal swing hinge assembly is configured to attach the gravity-closing gate to a rounded portion of the guardrail, and wherein the universal swing hinge assembly further comprises:

(i) one or more pipe bolt holes disposed through the lower hinge portion; and (ii) one or more clamps configured to be disposed around the rounded portion of the guardrail, wherein the pipe bolt holes and the clamps are configured to receive one or more pipe bolts for holding the universal swing hinge assembly and the gravity-closing gate to the rounded portion of the guardrail.

19. The universal swing hinge and gate assembly of claim 1, wherein:

a. when the universal swing hinge assembly is attached to the first side of the guardrail opening the universal swing hinge assembly allows the gravity-closing gate to only swing open towards the first side of the guardrail opening, and only swing closed towards the second side of the guardrail opening; and b. when the universal swing hinge assembly is attached to the second side of the guardrail opening the universal swing hinge assembly allows the gravity-closing gate to only swing open towards the second side of the guardrail opening, and only swing closed towards the first side of the guardrail opening.

20. The universal swing hinge and gate assembly of claim 1, wherein a height of the angled hinge face increases from an opening of the recess towards the back portion.

21. The universal swing hinge and gate assembly of claim 1, wherein the recess is configured to allow the gravity-closing gate to swing about a hinge pin axis on a hinge pin when the gravity-closing gate opens and closes.

22. The universal swing hinge and gate assembly of claim 1, wherein:

a. the recess has straight sides, and wherein the universal swing hinge assembly is installable on the guardrail such that the angled hinge face slopes upwards away from the guardrail opening; or b. the recess has straight sides, wherein the universal swing hinge and gate assembly further comprises a wedge member, and wherein the universal swing hinge assembly and the wedge member are installable on the guardrail such that the angled hinge face slopes upwards away from the guardrail opening.

23. The universal swing hinge and gate assembly of claim 1, wherein the universal swing hinge assembly has a C-configuration with the upper hinge portion and the lower hinge portion each extending from the back portion, and wherein:

a. when the universal swing hinge assembly is installed on the guardrail: a first side or a second side of the universal swing hinge assembly is engaged with the guardrail, such that upper hinge portion and the lower hinge portion both extend from the back portion towards the guardrail opening, and such that the recess opens towards the guardrail opening; and b. when the universal swing hinge assembly is uninstalled from the guardrail: the universal swing hinge assembly is configured to allow the gravity-closing gate to rotate about a hinge axis by at least 90 degrees in either direction from the lowest neutral position.

* * * * *